United States Patent [19]

Takahashi

[11] Patent Number: 5,052,835

[45] Date of Patent: Oct. 1, 1991

[54] ELECTRONIC TYPEWRITER WITH MULTIPLE MARGIN FORMAT CONTROL

[75] Inventor: Tsutomu Takahashi, Kawasaki, Japan

[73] Assignee: Canon Kabushiki Kaisha, Tokyo, Japan

[21] Appl. No.: 627,916

[22] Filed: Dec. 17, 1990

Related U.S. Application Data

[63] Continuation of Ser. No. 494,950, Mar. 15, 1990, abandoned, which is a continuation of Ser. No. 235,781, Aug. 23, 1988, abandoned, which is a continuation of Ser. No. 892,721, Jul. 28, 1986, abandoned, which is a continuation of Ser. No. 679,557, Dec. 7, 1984, abandoned.

[30] Foreign Application Priority Data

Dec. 14, 1983 [JP] Japan ..... 58-234196

[51] Int. Cl.[5] ..... B41J 25/18

[52] U.S. Cl. ..... 400/279; 400/62; 400/76; 364/519

[58] Field of Search ..... 400/41, 61-64, 400/67, 279, 280, 298, 303, 316, 348; 364/519

[56] References Cited

U.S. PATENT DOCUMENTS

| | | | |
|---|---|---|---|
| 3,579,193 | 5/1971 | Bernier | 400/64 |
| 3,915,278 | 10/1975 | Spence et al. | 400/64 |
| 3,923,137 | 12/1975 | Kashio | 400/64 |
| 3,952,852 | 4/1976 | Greek, Jr. et al. | 400/76 |
| 3,999,164 | 12/1976 | Kashio | 400/279 |
| 4,026,408 | 5/1977 | Byrd | 400/280 |
| 4,086,660 | 4/1978 | McBride | 400/76 |
| 4,087,852 | 5/1978 | Campbell et al. | 400/279 |
| 4,087,852 | 4/1978 | Campbell et al. | 400/64 |
| 4,114,750 | 9/1978 | Baeck et al. | 400/64 |
| 4,131,949 | 12/1978 | Fletcher et al. | 400/64 |
| 4,207,011 | 6/1980 | Pascoe | 400/76 |
| 4,240,758 | 12/1980 | Acosta | 400/279 |
| 4,265,554 | 5/1981 | Clancy et al. | 400/316 |
| 4,311,399 | 1/1982 | Wegyrn et al. | 400/279 |
| 4,334,286 | 6/1982 | Kerigan et al. | 400/279 |
| 4,403,301 | 9/1983 | Fessel | 400/279 |
| 4,462,701 | 7/1984 | Czyszczewski et al. | 400/64 |
| 4,484,826 | 11/1984 | Horn et al. | 400/76 |
| 4,495,600 | 1/1985 | Kikuchi et al. | 400/279 |
| 4,540,299 | 9/1985 | Yamada | 400/279 |
| 4,596,478 | 6/1986 | DeGeorge et al. | 400/76 |
| 4,686,649 | 8/1987 | Rush et al. | 400/64 |
| 4,725,158 | 2/1988 | Ueda et al. | 400/279 |
| 4,904,099 | 2/1990 | Abe et al. | 400/64 |

FOREIGN PATENT DOCUMENTS

| | | | |
|---|---|---|---|
| 25979 | 2/1982 | Japan | 400/279 |
| 106991 | 7/1982 | Japan | 400/279 |

OTHER PUBLICATIONS

Buchanan, "Automatic Carrier Return Inhibit" IBM Technical Disclosure Bulletin, vol. 22, No. 8B, p. 3760, 1/80.

McInroy et al., "Monetary and Numeric Formatting" IBM Technical Disclosure Bulletin, vol. 25, No. 11A, pp. 5606-5608, 4/83.

Hobgood et al., "Variable Left Margin . . . Control" IBM Technical Disclosure Bulletin, vol. 10, No 2, pp. 109-110, 7/67.

*Primary Examiner*—Eugene H. Eickholt

*Attorney, Agent, or Firm*—Fitzpatrick, Cella, Harper & Scinto

[57] ABSTRACT

There is provided an image processing apparatus for use in an electronic typewriter, wire dot printer or the like in which image information including character data is divided into a plurality of blocks and can be recorded as the continuous contents at a plurality of preset margin positions of a recording medium. The output format of the image information can be set for every divided block. Those set positions are variable for every output data amount of the image information or for every predetermined area of the output section of the image information. With this apparatus, image information can be divisionally and distributively recorded in many desired print areas due to simple key operations.

13 Claims, 3 Drawing Sheets

ELECTRONIC TYPEWRITER WITH MULTIPLE MARGIN FORMAT CONTROL

This application is a continuation of application Ser. No. 494,950 filed Mar. 15, 1990, now abandoned, which is a continuation of application Ser. No. 235,781, filed Aug. 23, 1988, now abandoned, which is a continuation of application Ser. No. 892,721 filed July 28, 1986, now abandoned, which is a continuation of application Ser. No. 679,557 filed Dec. 7, 1984, now abandoned.

BACKGROUND OF THE INVENTION

1. Field of the Invention

The present invention relates to an apparatus for performing image processes including a character process and, more particularly, to an image processing apparatus which can perform high grade image processes such as an editing and the like.

2. Description of the Prior Art

Conventionally, image processing apparatuses such as, for example, electronic typewriters, wire dot printers or the like have not been provided with a high grade editing function. When considering margins, only apparatuses which can record within desired margins on a recording medium under electronic control have been known.

In such kind of apparatus, the margins are set by setting the maximum scan width of the carriage which is equipped with the printing and recording mechanisms, or by other methods. In this case, although the margin can be moved to the right and left extremes of, for example, carriage movement, only a two margins are set; therefore, in the case where the operator wants to record a series of recording information on a sheet of recording medium or on a plurality of recording media by dividing such information into a plurality of blocks, or the like, fairly troublesome operations are needed.

On the other hand, for instance, in case of using an electronic typewriter to print characters for covered binding as a book or for two-sided printing on recording media prior to binding as a book, the printing has to be carried out by dividing the printing area of a recording paper into two blocks such as the back side and front side of the recording paper, or the even page and odd page, or the right section and left section of the same page. In such a case, the margins are first set in accordance with the (first) page on the left side and the recording is performed in the (first) page on the left side. Then in order to advance the recording to the (second) page on the right side, the margins have to be reset in accordance with this second page. Consequently, if the number of papers which should be recorded is large, the burden of these operations for the operator is heavy.

SUMMARY OF THE INVENTION

In consideration of the above-mentioned points, it is an object of the present invention to provide an apparatus, which can divide the data that should be recorded into a plurality of blocks and can easily record these blocks as due to continuous contents due to with a simple and inexpensive construction.

In consideration of the above points, it is an object of the invention to eliminate the foregoing drawbacks.

In consideration of the above points, it is an object of the invention to provide an image processing apparatus which is provided with means for setting a plurality of desired different margins when performing a series of recording operations and which can carry out the recording in consideration of a binding line.

In consideration of the above points, it is an object of the invention to provide an image processing apparatus which can change the region where the image process such as recording or the like is performed for each predetermined data to be processed.

In consideration of the above points, it is an object of the invention to provide an image processing apparatus which can control change of an output position of processed image data for any output on, for example, a paper, display i.e. the like, or for every recording medium.

In consideration of the above points, it is an object of the invention to provide an image processing apparatus in which data that should be outputted is divided into a plurality of blocks and can be outputted.

DETAILED DESCRIPTION OF THE PREFERRED EMBODIMENT

Figure 1:
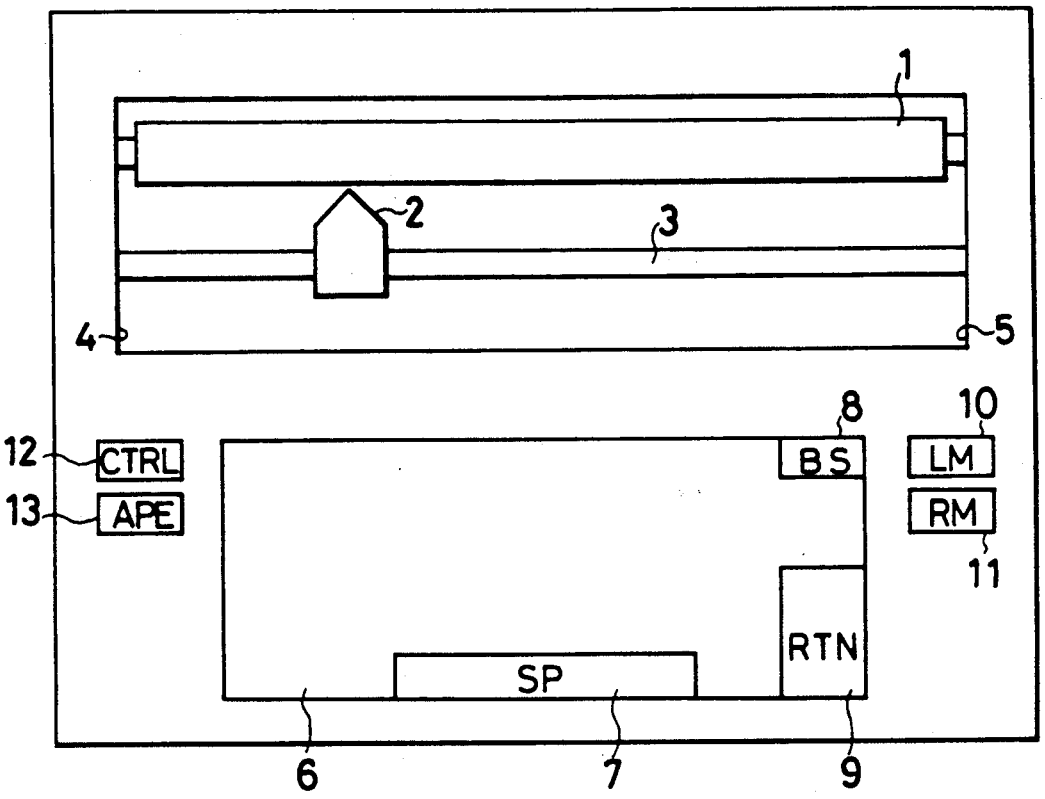
FIG. 1 is a top plan view illustrating diagrammatically one embodiment of a recording apparatus according to the present invention.

The present invention will now be described in detail hereinbelow with reference to an embodiment shown in the drawings.

FIG. 1 diagrammatically illustrates a structure of an electronic typewriter as an example of an image processing apparatus in which the present invention is employed.

In FIG. 1, a reference numeral 2 denotes a carriage which is equipped with a print mechanism using a daisy wheel or the like. The carriage 2 performs recording on a recording paper carried on a platen 1 while scanning to the right and left as shown in the FIG. on a guide rail 3 arranged along the platen 1. The moving range in the lateral direction of the carriage 2 is mechanically restricted to an area from a left end 4 to a right end 5, so that this range corresponds to the maximum recording width.

A keyboard for executing various kinds of operations is provided on this side of this printing mechanism. The keyboard comprises a key group (its detailed diagram is omitted) 6 consisting of keys for such as well-known symbols as characters, numerals and the like; a space key 7; a back space key (to advance the carriage to the left) 8; a carriage return key 9; and a left margin key (LM) 10 and a right margin key (RM) 11 to set the left and right margins (parameters to determine the output position of the extremes of recording and the range of positions on the recording medium of recording) which are further provided on the right side of the abovementioned keys.

Further, a control key (CTRL) 12 is provided at a left upper position of the keyboard in order to allow various kinds of control to be executed by pressing the control key 12 in combination with each of the above-mentioned keys.

A key (APE) 13 for setting the number of lines is also provided at a position below the control key 12. This key serves to set the number of lines to be printed on a recording paper wrapped around the platen 1.

Figure 2:
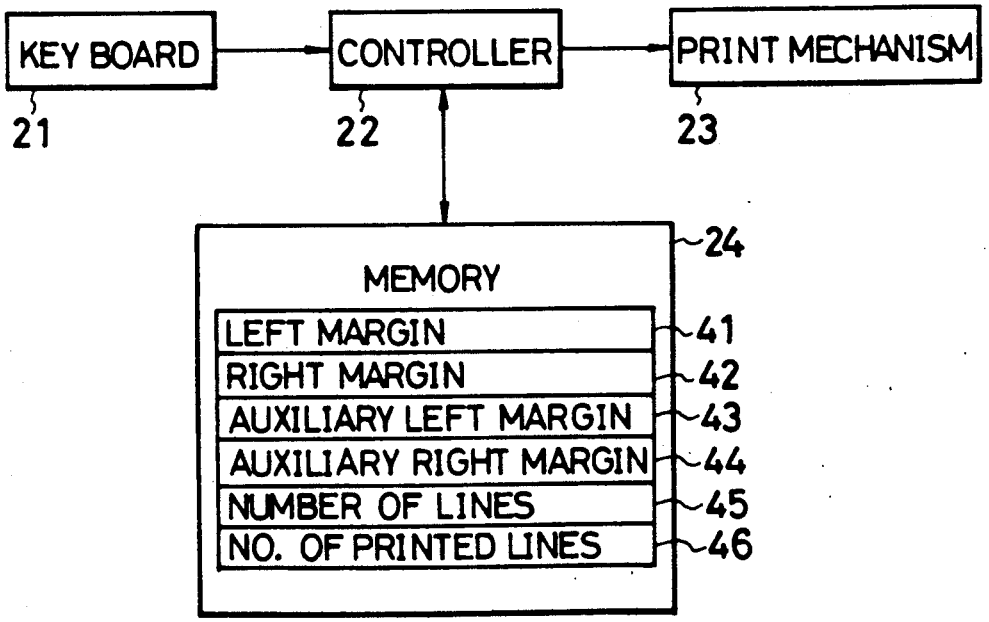
FIG. 2 is a block diagram showing an arrangement of a control system of the apparatus of FIG. 1.

Next, FIG. 2 is a block diagram showing an arrangement for a control circuit of the foregoing electronic typewriter. The above-described keyboard is indicated at a reference numeral 21. The operation input signal by the keyboard is inputted to a controller 22 constituted by a microcomputer or the like through a predetermined input circuit and the like. The input signal is subjected to a predetermined process by the controller 22, so that a print mechanism 23 of comprising the platen 1, carriage 2 and the like is driven in accordance with the operation input and the printing operation is performed.

A memory 24 consisting of a random access memory or the like is connected to the controller 22 in order to store a program, print data and the like for various kinds of controls which will be mentioned later. Pointers ^1 to 46 are set into predetermined memory areas in the memory 24 for the purpose of controls which will be explained later. Among those pointers, the pointer 41 is used to store the present position of the left margin which is actually used; the pointer 42 is likewise used to store the present of the right margin position which is used; and the pointers 43 and 44 are used to respectively store the auxiliary left and right margin positions which will be explained later. Also, the pointer 45 is for storage of the number of print lines in one page which is set by the operator, and the pointer 46 is for storage of the number of lines actually printed.

The operation in the above arrangement will now be described in detail with reference to FIGS. 3 and 4.

Figure 3:
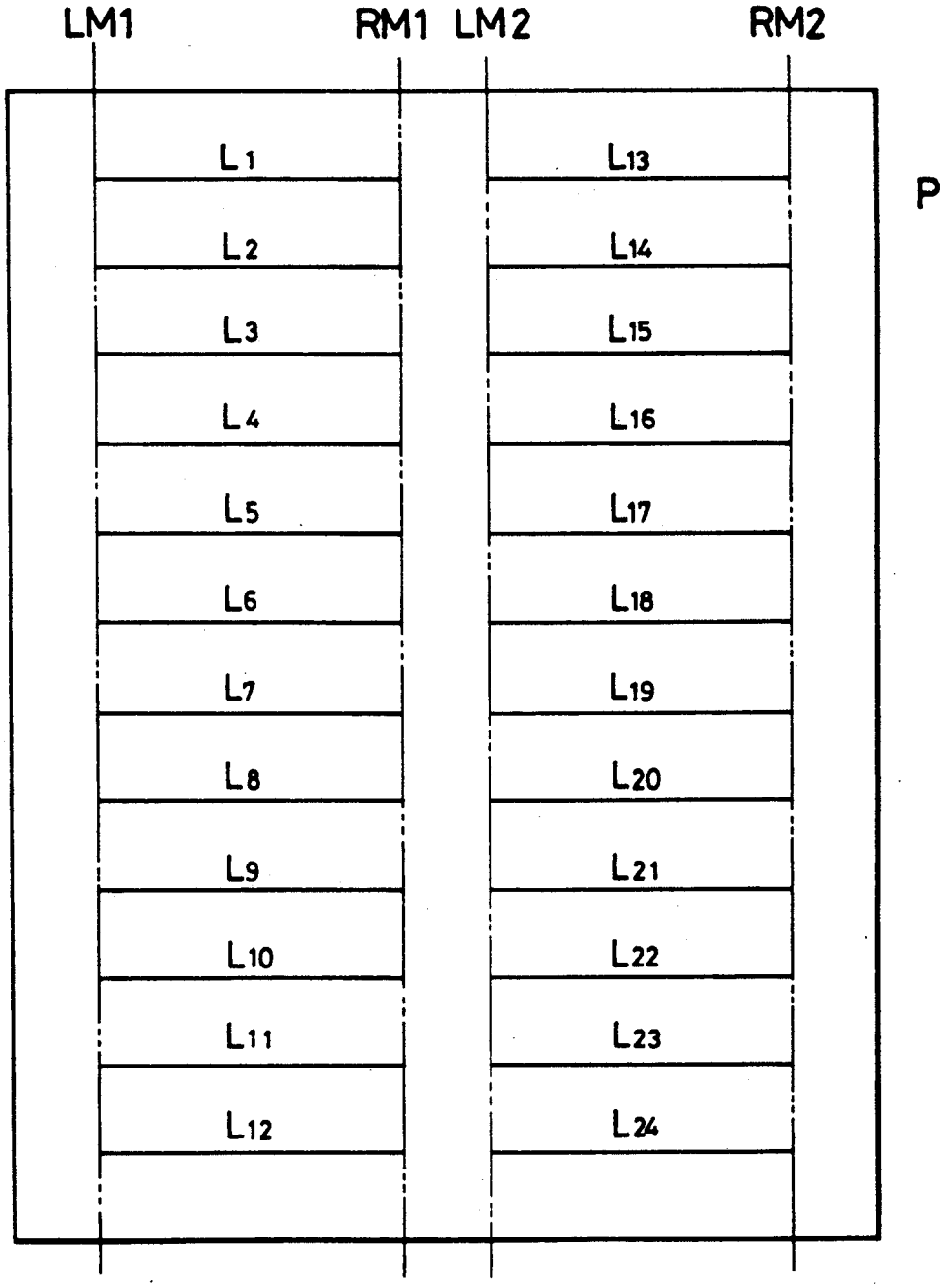
FIG. 3 is an explanatory diagram showing the operation in the recording apparatus of the invention.

It is now assumed that a total twenty-four lines have to be printed in the right and left blocks each having twelve lines of a recording paper P as shown in FIG. 3. However, this print format is similar to the case in the double-faced recording. The respective print lines are simply indicated by numerals L1 to L24. Namely, it is assumed that the print lines L1 to L12 are printed in the margins indicated at LM1 to RM1 on the left side of the recording paper P, while the print lines L13 to L24 are printed in the margins indicated at LM2 to RM2 on the right side of the recording paper P. However, as mentioned before, the margins may be set in a manner such that the lines L1 to L12 are printed in the first page and the lines L13 to L24 are printed in the second page.

Figure 4:
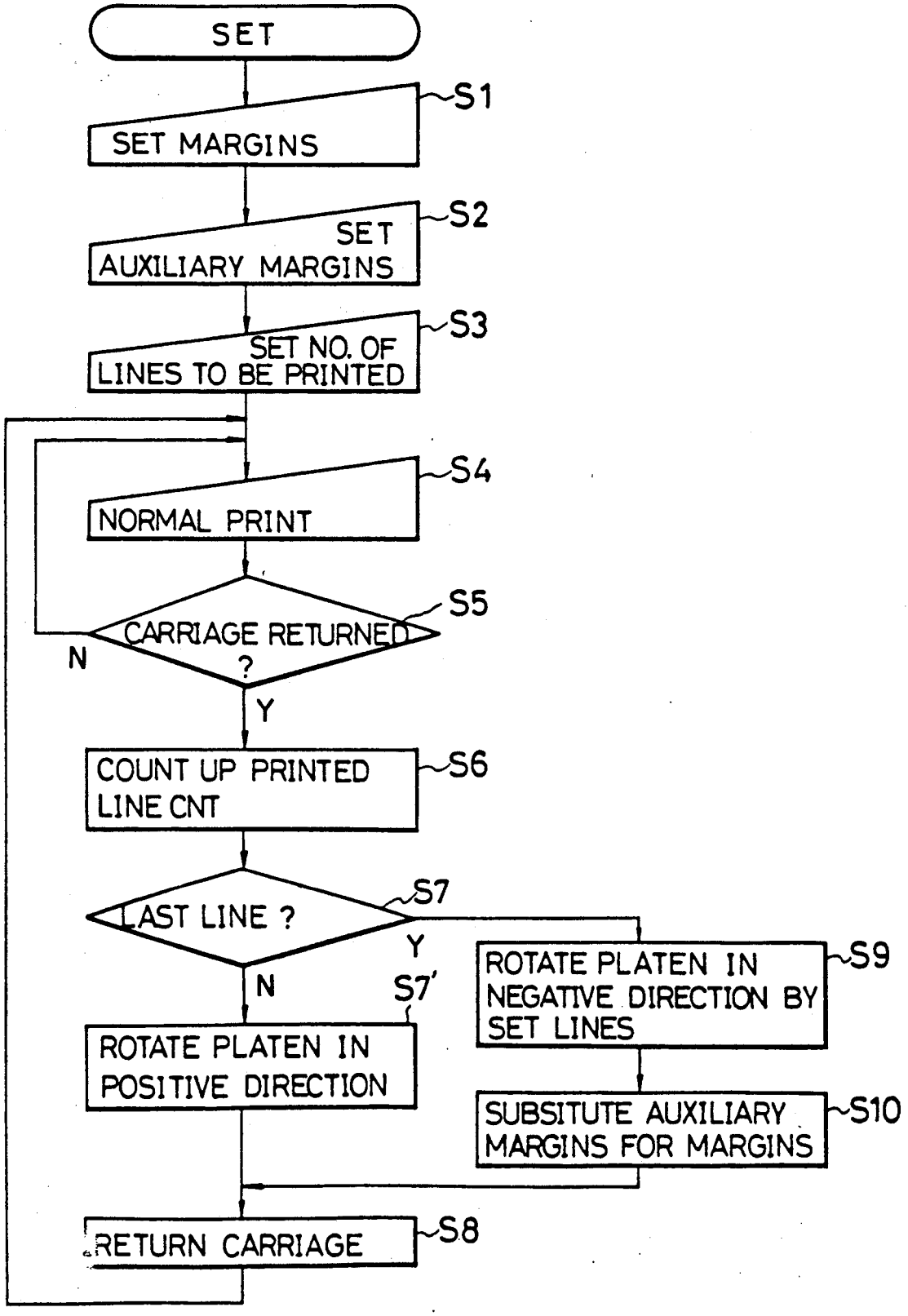
FIG. 4 is a flow chart for explaining the flow of operations in the recording apparatus of the invention.

Such recording operations are performed in accordance with a procedure shown in a flow chart of FIG. 4.

First, the margins are set by the operator in step S1 in FIG. 4. These margins may be set in a well-known manner using the left and right margin keys 10 and 11. Namely, the carriage 2 is set at a desired position using the space key 7 or back space key 8 and the left and right margin keys 10 and 11 are depressed at selected positions, thereby allowing the margins to be completely set. The left and right margin positions set in this way are respectively stored as the forms of the positions of the carriage 2 in the pointers 41 and 42 of the memory 24. In the example of FIG. 3, the left and right margins are respectively set at the positions of LM1 and RM1 of the preset recording paper P.

The auxiliary margins are set in step S2. The print data corresponding to the block on the right side in FIG. 3 is recorded in accordance with these auxiliary margins. The auxiliary margins are set in a similar manner to step S1; that is, the positions of the carriage 2 are set and the left and right margin keys 10 and 11 are depressed at the desired positions together with the control key 12. On the other hand, in FIG. 1, the margins may be obviously set by providing an auxiliary left/right or even/odd page designating key. In the example of FIG. 3, the auxiliary left margin is set at the position of LM2 and the auxiliary right margin is set at the position of RM2. These positions are stored in the pointers 43 and 44 of the memory 24, respectively.

The number of lines in one page is then set in step S3. The number of lines is set by use of the key 13 for setting the number of lines and the numeric keys in the key group 6. For instance, by pressing the key 13 and then the numeric keys, the number of lines is set. In case of FIG. 3, "12" is set.

In the loop of steps S4 to S5, the controller 22 drives the print mechanism 23 comprising the platen 1, carriage 2 and the like in accordance with the operation input from the keyboard 21 and the input characters are sequentially printed in accordance with the well-known procedure until a carriage return command is inputted using the carriage return key 9.

In step S5, depression of the carriage return key 9 is detected by the controller 22 and in the case where the carriage return command is inputted, step S6 follows.

In step S6, the pointer 46 storing the number in printed lines of the memory 24 is counted up, thereafter the process routine advances to step S7.

In step S7, a check is made to see if the line just printed is the last line of the page or not. This discrimination is made by comparing the content of the pointer 45, in which the number of lines which has been preset by the operator is stored with the content of the pointer 46 counted up to the line just printed. When they are not determined to be equal as the result of comparison, the platen 1 is rotated by a predetermined unit amount in the positive direction in step S7' Subsequently, the carriage 2 is returned to the left margin position (position of LM1 in case of FIG. 3) stored in the pointer 41 in step S8, and then the normal carriage return operation is executed. When the contents are equal in the comparison in step S7, this means that recording of the print line L12 in FIG. 3 has ended. In this case, step S9 follows.

In step S9, the apparatus is prepared for in the block on the right side. Therefore, the platen 1 is reversely rotated by only the set number of lines stored in the pointer 45 (and 46), thereby setting the carriage 2 at the position of the first line, in FIG. 3, at the positions of the print lines L1 to L13. Subsequently, in step S10, the controller 22 respectively shifts the auxiliary left and right margins stored in the pointers 43 and 44 to the pointers 41 and 42, thereby allowing these values to be used hereinafter as the left and right margins. After the carriage 2 was returned in accordance with those new margins in step S8, the process routine is returned to step S4 and the recording is then performed in the block on the right side in a similar manner described above. In the above description, the example has been given whereby the recording is performed in the left block and then in the right block, namely, the recording in the left block is carried out by setting the margins and the recording in the right block is executed by setting the auxiliary margins. However, even if the left and right blocks are reversed, the recording can be performed with a similar construction. On the other hand, in case of the two-sided printing as well, the margins in accordance with each page can be automatically set due to the designation of pages (for instance, the page designation by the above-mentioned left/right or even/odd page designating key).

As described above, a plurality of margins can be set for a printing range including a first page, second page, a front page, a back page, etc. without being limiting to one page. The continuous contents can be simply printed as the divided blocks without requiring troublesome margin resetting operations. In addition, the present invention can be implemented by small modifications of hardware and software, in order to contribute to the reduction in cost of the apparatus.

Although an example of an electronic typewriter has been described in the above embodiment, the invention can be obviously applied to recording apparatuses of other types. In addition, although only a set of left and right auxiliary margins has been shown in the above as an example, if a number of pointers are set and the preset values are sequentially used, a further greater number of margins can be set in the recording area.

As will be apparent from the above description, according to the present invention, there is adopted an arrangement providing means for setting a plurality of desired output ranges or different margins when performing a series of recording. Therefore, it is possible to provide a simple, inexpensive and excellent recording apparatus in which the recording data is divided into a plurality of blocks by simple operations and a plurality of recorded lines whose contents are continuous can be formed.

Also, predetermined amounts of image processed data can be outputted into different areas. In addition, the recording data can be outputted into different areas within predetermined ranges on the paper or display section.

On the other hand, the data to be handled may be character information having an image, or only character information, or information having only image information. Further, the character information in the present invention may be code information or image information.

What is claimed is:

1. An apparatus for outputting information on a recording sheet comprising:

output means for outputting information on a recording sheet;

movement instruction means for instructing the moving of said output means without said output means outputting the information;

determination means for determining margin positions defining not less than two areas according to a position of said output means moved according to an instruction from said movement instruction means;

line input means for setting the number of lines common to each area determined by said determination means;

carrying means for carrying a recording sheet in forward and reverse direction;

a first memory for storing not less than two pairs of left and right margins defining each area;

a second memory for storing the number of lines; and control means for controlling, on the basis of data stored in said first and second memories, said output means to output information on one area of a surface of the recording sheet when said carrying means carries the recording sheet in a forward direction, then said control means next controls said carrying means to carry the recording sheet in a reverse direction, wherein said control means positions said output means at a record starting position on another area of the surface of the recording sheet, and then said control means controls said output means to output information on the another area of the surface of the recording sheet.

2. An apparatus according to claim 1, wherein said controlling means includes a count section for counting an amount of lines which have been output.

3. An apparatus according to claim 1, wherein said output means includes a platen comprising said carrying means and carriage and, to process images for printing two pages of characters on said surface of said recording sheet, said control means controls said platen to rotate in a direction opposite to the direction in which said platen is rotated for printing the number of lines set by said line number setting means, and controls said carriage to move to the second left margin before starting subsequent printing.

4. An apparatus according to claim 1, wherein said output means prints information on the number of lines input by said line input means, wherein said control means includes means for counting the number of lines printed and means for comparing said counted number of lines input by said line input means.

5. An apparatus according to claim 1, wherein said output means has a display wheel.

6. An apparatus according to claim 1, wherein said movement instruction means includes a space key and back space key.

7. A printing apparatus for printing character information on one and the other sides of a sheet manually turned over by an operator, comprising:

printing means, including a platen, movable along said platen for printing character information;

first set means for setting a first print format for the one surface of a single sheet according to a position of said printing means;

second set means for setting a second print format for the other surface of the single sheet, following the one surface, according to a position of said printing means;

memory means for storing first and second format information corresponding to the first and second print formats set by said first and second set means, respectively;

determining means for determining whether said printing means has completely printed character information on the one surface in response to the first format information stored in said memory means; and control means for controlling said printing means such that the after said determining means determines that said printing means has completely printed character information on the one surface in response to the first format information, said printing means starts printing character information on the other surface in response to the second format information after the operator has manually turned over the sheet.

8. An apparatus according to claim 7, wherein said first set means sets a number of lines to be printed as at least a portion of said first print format and wherein said control means includes means for counting the number of lines printed by said printing means and means for comparing said counted number of lines with the number of lines set by said first set means.

9. An apparatus according to claim 7, wherein said printing means has a display wheel.

10. An apparatus according to claim 7, wherein said second set means sets a number of lines to be printed as at least a portion of said first print format and wherein said control means includes means for counting the number of lines printed by said printing means and means for comparing said counted number of lines with the number of lines set by said second set means.

11. An apparatus according to claim 7, wherein the one side surface is a front surface, and the other side surface is a back surface.

12. An apparatus according to claim 7, wherein said first set means includes means for moving said printing means without a printing operation being performed.

13. An apparatus according to claim 7, wherein said second set means includes means for moving said printing means without a printing operation being performed.

* * * * *

UNITED STATES PATENT AND TRADEMARK OFFICE

CERTIFICATE OF CORRECTION

PATENT NO. : 5,052,835 Page 1 of 2

DATED : October 1, 1991

INVENTOR(S) : TSUTOMU TAKAHASHI

It is certified that error appears in the above-identified patent and that said Letters Patent is hereby corrected as shown below:

Title page,

At [56], "4,087,852 4/1978 Campbell et al. ... 400/64" should be deleted.

SHEET 3 OF THE DRAWINGS

Figure 4, S10, "SUBSITUTE" should read -- SUBSTITUTE --.

COLUMN 1

Line 33, "a" should be deleted.
Line 61, "due to" should be deleted (both occurrences).

COLUMN 2

Line 12, "i.e. the like, or" should read -- or the like, i.e. --.
Line 52, "as" should be deleted.
Line 60, "abovemen-" should read -- above-men- --.

COLUMN 3

Line 4, "for" should read -- of --; and "of" should read -- for --.
Line 11, "of" should be deleted.
Line 24, "of the right margin position" should read -- position of the right margin --.

UNITED STATES PATENT AND TRADEMARK OFFICE

CERTIFICATE OF CORRECTION

PATENT NO. : 5,052,835

DATED : October 1, 1991

INVENTOR(S) : TSUTOMU TAKAHASHI

It is certified that error appears in the above-identified patent and that said Letters Patent is hereby corrected as shown below:

COLUMN 4

Line 25, "in" should read -- of --.
Line 26, "of" should read -- in --.
Line 36, "step S7' Subsequently, " should read --step S7'. Subsequently, --.
Line 44, "for in" should read -- for recording in --.
Line 57, "described" should read -- as described --.

COLUMN 5

Line 4, "second" should read -- a second --.

COLUMN 6

Line 54, "the after" should read -- after --.

Signed and Sealed this

Twentieth Day of April, 1993

*Attest:*

*Attesting Officer*

MICHAEL K. KIRK

*Acting Commissioner of Patents and Trademarks*